US009151143B2

(12) United States Patent
Holderman et al.

(10) Patent No.: US 9,151,143 B2
(45) Date of Patent: Oct. 6, 2015

(54) SACRIFICIAL PLUG FOR USE WITH A WELL SCREEN ASSEMBLY

(75) Inventors: Luke William Holderman, Plano, TX (US); Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 625 days.

(21) Appl. No.: 13/552,647

(22) Filed: Jul. 19, 2012

(65) Prior Publication Data

US 2014/0020898 A1 Jan. 23, 2014

(51) Int. Cl.

| | |
|---|---|
| ***E21B 43/10*** | (2006.01) |
| ***E21B 43/08*** | (2006.01) |
| ***E21B 43/12*** | (2006.01) |

(52) U.S. Cl.

CPC ..... *E21B 43/08* (2013.01); *E21B 43/12* (2013.01)

(58) Field of Classification Search

CPC ..... E21B 43/12; E21B 43/08; E21B 34/06; E21B 34/063; E21B 34/08; E21B 34/10; E21B 41/00; E21B 33/1208; E21B 33/134; E21B 43/10; E21B 33/12

See application file for complete search history.

(56) References Cited

U.S. PATENT DOCUMENTS

| | | | | |
|---|---|---|---|---|
| 7,699,101 | B2 | 4/2010 | Fripp et al. | |
| 7,832,473 | B2 * | 11/2010 | Pensgaard | 166/193 |
| 8,230,935 | B2 | 7/2012 | Gano et al. | |
| 8,256,510 | B2 | 9/2012 | Holderman et al. | |
| 8,256,522 | B2 | 9/2012 | Veit et al. | |
| 8,291,985 | B2 | 10/2012 | Holderman | |
| 8,356,668 | B2 | 1/2013 | Dykstra et al. | |
| 8,356,669 | B2 | 1/2013 | Holderman | |
| 8,430,173 | B2 | 4/2013 | Todd et al. | |
| 8,430,174 | B2 | 4/2013 | Holderman et al. | |
| 8,434,559 | B2 | 5/2013 | Todd et al. | |
| 8,490,690 | B2 | 7/2013 | Lopez | |
| 8,499,827 | B2 | 8/2013 | Dusterhoft et al. | |
| 8,573,311 | B2 | 11/2013 | Zhao et al. | |
| 8,579,025 | B2 | 11/2013 | Holderman et al. | |
| 8,596,366 | B2 | 12/2013 | Franklin et al. | |
| 8,602,106 | B2 | 12/2013 | Lopez | |
| 8,602,110 | B2 | 12/2013 | Kuo et al. | |
| 2008/0283238 | A1 | 11/2008 | Richards et al. | |

(Continued)

FOREIGN PATENT DOCUMENTS

| | | | |
|---|---|---|---|
| WO | 2012011994 | A1 | 1/2012 |

OTHER PUBLICATIONS

Foreign Communication from a Related Counterpart—International Search Report and Written Opinion, dated Sep. 13, 2013, International Serial No. PCT/US2013/047731, filed on Jun. 25, 2013.

*Primary Examiner* — David Andrews
*Assistant Examiner* — Carib Oquendo
(74) *Attorney, Agent, or Firm* — Scott Richardson; Baker Botts L.L.P.

(57) ABSTRACT

A well screen assembly for use downhole comprises a fluid pathway configured to provide fluid communication between an exterior of a wellbore tubular and an interior of the wellbore tubular, a flow restrictor disposed in the fluid pathway, and a plug disposed in series with the flow restrictor in the fluid pathway. The plug substantially prevents a fluid flow through the fluid pathway. The plug is configured to be at least partially dissolvable when contacted by a fluid, and the fluid comprises a chemical configured to dissolve the plug.

16 Claims, 4 Drawing Sheets

(56) References Cited

U.S. PATENT DOCUMENTS

| | | | |
|---|---|---|---|
| 2010/0051270 | A1 | 3/2010 | Dusterhoft et al. |
| 2011/0011577 | A1 | 1/2011 | Dusterhoft et al. |
| 2011/0220362 | A1 | 9/2011 | Huang et al. |
| 2013/0037276 | A1 | 2/2013 | Kuo et al. |
| 2013/0153238 | A1 | 6/2013 | Fripp et al. |
| 2013/0186626 | A1 | 7/2013 | Aitken et al. |
| 2013/0213667 | A1 | 8/2013 | Lopez et al. |
| 2013/0220632 | A1 | 8/2013 | Greci et al. |
| 2013/0264072 | A1 | 10/2013 | Lopez et al. |
| 2013/0276901 | A1 | 10/2013 | Holderman |
| 2013/0277059 | A1 | 10/2013 | Holderman et al. |
| 2013/0284452 | A1 | 10/2013 | Franklin et al. |

* cited by examiner

SACRIFICIAL PLUG FOR USE WITH A WELL SCREEN ASSEMBLY

CROSS-REFERENCE TO RELATED APPLICATIONS

Not applicable

STATEMENT REGARDING FEDERALLY SPONSORED RESEARCH OR DEVELOPMENT

Not applicable.

BACKGROUND

The disclosure relates generally to equipment utilized and operations performed in conjunction with a subterranean well and, more particularly, to the application of sacrificial plugs in a well system. Without limiting the scope of the disclosure, its background will be described with reference to producing fluid from a hydrocarbon bearing subterranean formation, as an example. During the production of hydrocarbons from a subterranean well, a route of fluid communication in a wellbore penetrating a subterranean formation may be altered for various reasons. For example, one or more ports of a tubular member disposed within the wellbore may be bypassed to allow for a flowpath between the wellbore and the tubular member.

Other components of a well system may also be bypassed. For instance, a component that is subject to failure or reduction in efficiency, such as by clogging or other means, may be bypassed. For example, inflow control devices (ICDs), while beneficial for a period of time in balancing hydrocarbon production from a wellbore, limit the ability to reach a desired production rate once a significant amount of water or gas begins to be produced from the wellbore. Typical bypass mechanisms may require a physical intervention in the well in the form of a mechanical shifting component to open a bypass. These types of mechanisms and their associated methods can be expensive due to the time necessary to set up a workover rig and trip in and out of the wellbore with the shifting component.

SUMMARY

In an embodiment, a well screen assembly for use downhole comprises a fluid pathway configured to provide fluid communication between an exterior of a wellbore tubular and an interior of the wellbore tubular, a flow restrictor disposed in the fluid pathway, and a plug disposed in series with the flow restrictor in the fluid pathway. The plug substantially prevents a fluid flow through the fluid pathway. The plug is configured to be at least partially dissolvable when contacted by a fluid, and the fluid comprises a chemical configured to dissolve the plug.

In an embodiment, a well screen assembly for use in a wellbore comprises a first fluid pathway configured to provide fluid communication between an exterior of a wellbore tubular and an interior of the wellbore tubular, a flow restrictor disposed in the first fluid pathway, and a plug disposed in parallel with the flow restrictor. The plug is configured to be at least partially dissolvable when contacted by a suitable fluid, and the plug is configured to create a second fluid pathway between an exterior of the wellbore tubular and the interior of the wellbore tubular when at least partially dissolved.

In an embodiment, a method comprises preventing, by a plug, fluid flow through a fluid pathway in a well screen assembly, contacting the plug with a first suitable fluid, at least partially dissolving the plug in response to the contact with the first suitable fluid, and allowing the fluid flow through the fluid pathway in response to at least partially dissolving the plug. The fluid pathway is configured to provide fluid communication between an exterior of a wellbore tubular and an interior of the wellbore tubular, and a flow restrictor is disposed in the fluid pathway.

These and other features and characteristics will be more clearly understood from the following detailed description taken in conjunction with the accompanying drawings and claims.

BRIEF DESCRIPTION OF THE DRAWINGS

For a detailed description of the disclosed embodiments, reference will now be made to the accompanying drawings in which.

DETAILED DESCRIPTION

Figure 1:
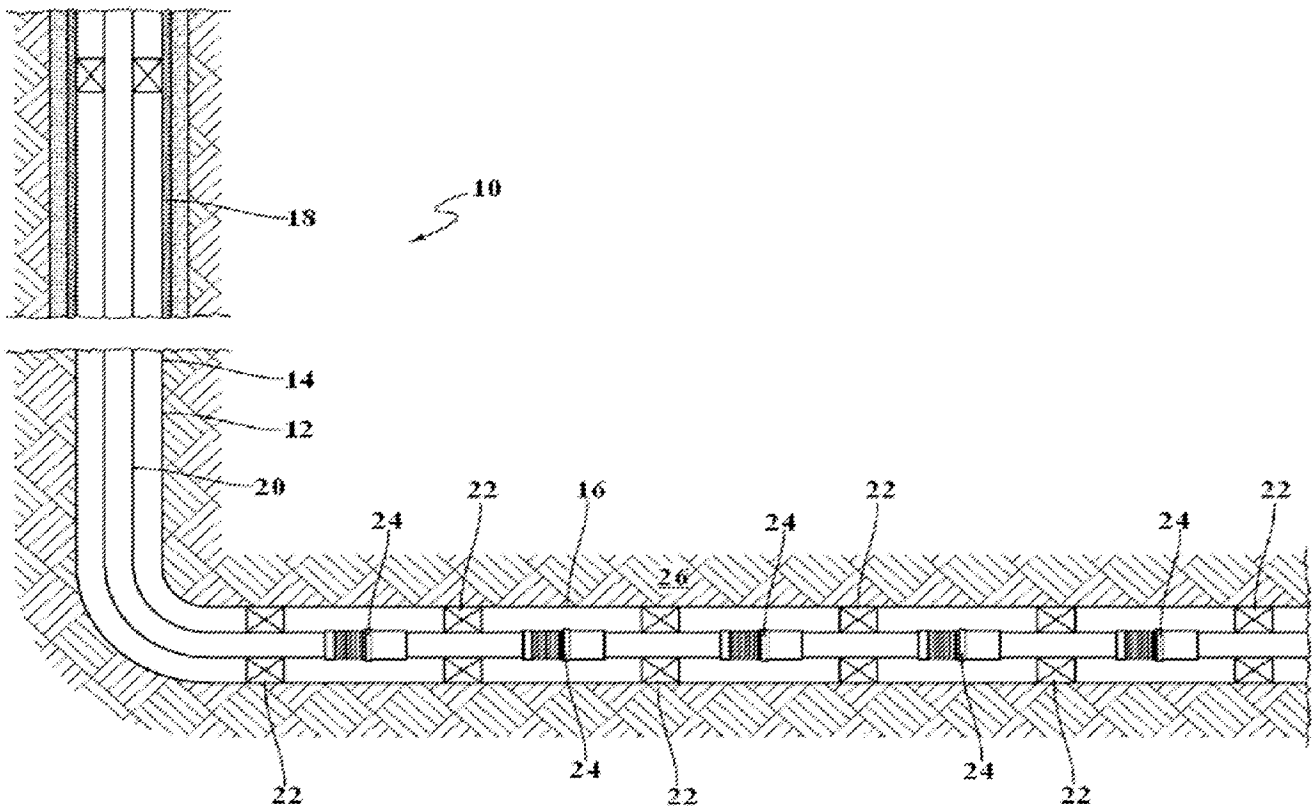
FIG. 1 is a schematic illustration of a well system including a plurality of well screen assemblies according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "uphole" meaning toward the surface of the wellbore and with "down," "lower," "downward," or "downhole" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation, such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Well systems may be used to provide a completion configuration including one or more flow restrictions intended to balance production along a section of the wellbore. However, a substantial amount of water or gas may begin being produced from the formation during the life of the well system. After the onset of water or gas production, it may be desirable to reduce any flow restrictions created by flow restrictors in order to increase production from the formation. While flow restrictors may be desirable for delaying the point when water or gas production begins, higher flow rates into the well may be used after this point in time in order to extract any remaining hydrocarbons from the surrounding formation. Accordingly, an apparatus and method are disclosed herein for quickly and efficiently bypassing any flow restrictors after they have been installed downhole in the wellbore without the need for physically intervening into the wellbore. Further, the apparatus and methods disclosed herein may also be used to quickly and effectively bypass other components of a well system (e.g., check valves, sliding sleeves, obturating members, etc.) without the need for physically intervening into the wellbore.

While a number of mechanisms may be used, it will be appreciated that a well screen assembly disclosed herein comprises a flow restrictor (e.g., an ICD, autonomous inflow control device (AICD), and/or a check valve), and a plug configured to be dissolved downhole by a fluid introduced to the wellbore. One or more plugs may be disposed in series and/or parallel with the flow restrictor. Each plug may comprise a material that may be configured to at least partially dissolve in response to contact with a fluid comprising a suitable chemical (e.g., an acid, an acid generating compound, a base, a base generating compound, etc.). The dissolution of the plug may provide for a route of fluid communication and/or an alternative route of fluid communication through the well screen assembly. In an embodiment, the at least partial dissolution of the plug may open an initial flow path through the well screen assembly. In an embodiment, the at least partial dissolution of the plug may divert fluid flow around the flow restrictor of the well screen assembly along a second flow path, thereby allowing for the flow restrictor to be bypassed without requiring a mechanical intervention in the well. In an embodiment, the second flow path may have a smaller pressure drop in a fluid flow between the first port and the second port. Thus the bypass assembly may be configured to allow fluid to be produced along a first flow path, dissolve a plug in response to contact with a chemical, and thereafter produce the fluid along a second flow path. Similarly, the bypass assembly may be configured to produce a fluid with a first pressure drop, dissolve a plug in response to contact with a chemical, and thereafter produce the fluid with a second pressure drop that is different than the first pressure drop.

In an embodiment, a plurality of the well screen assemblies comprising dissolvable plugs may be used with a plurality of flow restrictors disposed in a wellbore. The one or more well screen assemblies may be configured to allow for a route of fluid communication therethrough in response to the at least partial dissolution of the sacrificial plug. The one or more well screen assemblies may be configured to bypass a flow restrictor, such as an ICD, in response to the at least partial dissolution of a sacrificial plug. Other components of a well system may also be configured to allow for the bypass thereof in response to the at least partial dissolution of a sacrificial plug. Further, different sacrificial plugs may be configured to at least partially dissolve in response to contact by different fluids or chemicals, allowing for the bypassing or opening of routes of fluid communication in a portion of the well screen assemblies disposed in the wellbore. Certain well screen assemblies may also be isolated from contact of a chemical configured to dissolve the sacrificial plugs, also allowing for the selective dissolution of a portion of the plugs in the wellbore.

Referring initially to FIG. 1, therein is depicted an exemplary well system 10 comprising a wellbore 12 with both a substantially vertical section 14 and a substantially horizontal section 16, casing 18, tubular string 20, plurality of spaced apart packers 22 and well screen assemblies 24, and a formation 26. Additional or different equipment may be included in the tubular string 20, if desired (for example, packers 22 could instead be bridge plugs, multiple zones could be gravel packed, etc.).

In an embodiment, production of hydrocarbons may be accomplished by flowing hydrocarbon containing fluid from the formation 26 into tubular string 20 via screen assembly 24. In this exemplary embodiment, screen assemblies 24 may provide for the filtering of unwanted material from the formation 26 and for the metering of fluid input from the formation into the tubular string 20. Packers 22 can isolate each individual well screen assemblies 24 into different zones or intervals along the wellbore 12 by providing a seal between the outer wall of the wellbore 12 and tubular string 20. In an embodiment, well screen assemblies 24 may generally comprise a screen or filter and an inflow control device (ICD) to restrict or meter fluid flow through the assembly 24, as will be discussed further herein.

Although FIG. 1 depicts the well screen assemblies 24 in an open and uncased horizontal section 16, it is to be understood that the flow control devices are equally suited for use in cased wellbores. For instance, the well screen assemblies 24 and packers 22 may be used for flow control purposes when injecting treatment chemicals, such as acids, into the perforations of a cased wellbore. Further, although FIG. 1 depicts single well screen assemblies 24 as being isolated by the packers 22, it is to be understood that any number of well screen assemblies 24 may be grouped together and isolated by the packers 22, without departing from the principles of the present disclosure. In addition, even though FIG. 1 depicts the well screen assemblies 24 in a horizontal section 16, it is also to be understood that the flow control devices are equally suited for use in wellbores having other directional configurations including vertical wellbores, deviated wellbores, slanted wellbores, multilateral wellbores, and the like.

In an embodiment, tubular string 20 may be used to produce hydrocarbons from formation 26 after a completion operation, where fluid may be circulated down to the lower most section of the wellbore 12 and recirculated upward via tubular string 20. Further, a gravel packing operation may also be utilized prior to producing fluid from the formation 26. In the gravel packing operation, a gravel slurry may be displaced partially downward through wellbore 12 in order to form a gravel pack adjacent to a well screen assembly 24. The formed gravel pack may be used to restrict the flow of sand from the formation 26 to the well screen assembly 24 to protect assembly 24 from clogging with formation sand and other debris. In this embodiment, during the circulation or gravel packing operation flow through well screen assemblies 24 may be restricted so that circulating fluid or the gravel slurry may not damage or plug the assemblies 24. Following the completion of a circulation or gravel packing operation, flow of fluid through well screen assemblies 24 may be permitted so that fluid may be produced from the formation 26 via the tubular string 20 and well screen assemblies 24. Accordingly, an apparatus and method are disclosed herein for opening a route of fluid communication through assemblies 24 after they have been installed downhole in the wellbore 12 without the need for physically intervening into the wellbore.

Figure 2A:
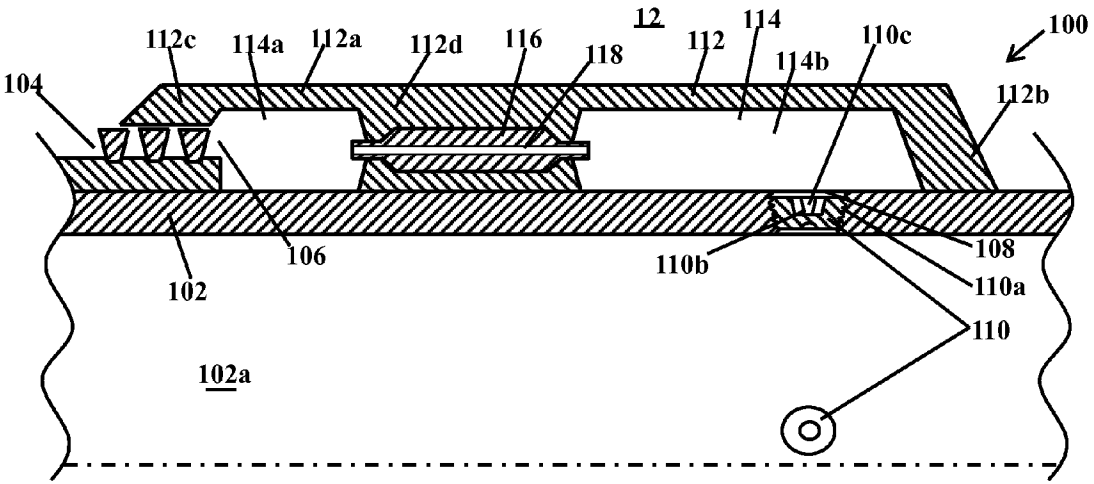
FIG. 2A is a partial cross-sectional view of an embodiment of a well screen assembly for selectively providing a route of fluid communication in a well system shown in a first configuration.

In an embodiment, the plug may be placed in series with the flow restrictor to allow the flow path to be selectively opened. Referring now to FIG. 2A, therein is depicted a partial cross-sectional view of an embodiment of a first configuration of a well screen assembly 100 that may be suitable for use as a well screen assembly 24 previously described with reference to FIG. 1. Well screen assembly 100 generally includes a pipe or tubular member 102, a filter 104, a first or inlet port 106, a plurality of second or outlet ports 108 with a sacrificial plug 110 disposed in one or more of the second ports 108, a housing 112 that partially defines chambers 114*a*, 114*b* and a flow restrictor 116 having a central passage 118 extending therethrough.

The tubular member 102 comprises any tubular member capable of being used downhole and communicating fluid at high pressures. The tubular member 102 forms a portion of the tubular string 20 described above with reference to FIG. 1. Tubular member 102 includes an internal fluid passageway 102*a*, through which fluids may be conveyed in both uphole and downhole directions, and the plurality of outlet ports 108, which may be disposed circumferentially about tubular member 102 and may extend generally radially through the tubular member 102.

In an embodiment, a sacrificial plug 110 may be disposed at least partially within one or more of the outlet ports 108, and the sacrificial plug 110 may be configured to at least partially dissolve in response to contact with a fluid comprising a suitable chemical at a faster rate than the tubular member 102. In an embodiment, the plug 110 may be threadedly engaged to tubular member 102 using threads 110*a*. In some embodiments, the plug 110 may be press-fit, shrink-fit, adhesively bonded, welded, and/or otherwise secured in the second port 108. As shown in FIG. 2A, the engagement between plug 110 and tubular member 102 may be configured to substantially restrict fluid communication between passage 102*a* and the wellbore 12 via port 108. In an embodiment, one or more seals (e.g., o-rings, sealants, and the like) may be disposed between the plug 110 and the second port 108 to form a sealing engagement.

The plug 110 may be configured to be at least partially disposed within the second port 108. The plug 110 may comprise any shape allowing it to be disposed and retained within the second port 108. For example, the plug may be generally cylindrical, frusto-conical, rectangular (e.g., cubic), spherical, elliptical, or oblong. One or more engaging features may be disposed on an outer surface of the plug to allow it to be disposed within the second port 108. As noted above, threads may be used, though the outer surface may also comprise roughening, serrations, protrusions, recesses, interlocking teeth or the like. In an embodiment, the plug 110 may comprise a rivet like structure. As shown in FIG. 2A, the plug 110 may have an inner surface 110*b* that defines a cavity 110*c* partially extending into plug 110. The cavity may allow for an increased surface area for contact with a fluid, which may increase the dissolution rate of the plug 110. In an embodiment, the plug 110 may be solid, at least in part, to control the rate of dissolution and/or to provide the desired mechanical strength of the plug within the second port 108.

Plug 110 may comprise any material suitable for at least partially dissolving when contacted by a fluid comprising a suitable chemical while having the strength to withstand a pressure differential across the plug prior to being contacted with the fluid. The dissolvable material may form a portion of the plug or the entire structure of the plug. In an embodiment, the dissolvable material may form only a portion of the plug sufficient to form a fluid passage through the plug and/or allow the plug to disengage the second port 108. In an embodiment, an outer surface of the plug 110 engaging the second port 108 may comprise a dissolvable material that dissolves to release an inner portion of the plug from the second port 108. In an embodiment, a central portion of the plug may comprise a dissolvable material that dissolves to form a flow passage through the plug without the plug being wholly removed from the second port 108. In an embodiment, the dissolvable material may form a portion of a composite material, for example as the particular phase or the matrix phase. Upon the dissolution of the dissolvable portion, the remaining component of the composite material may disintegrate or otherwise disperse based on a lack of structure integrity, thereby remove the plug 110 from the second port 108.

The one or more materials used to form the plug 110, or at least a portion of the plug 110, may be configured to at least partially dissolve. In an embodiment, plug 110 may comprise an acid soluble metal including, but not limited to, barium, calcium, sodium, magnesium, aluminum, manganese, zinc, chromium, iron, cobalt, nickel, tin, any alloy thereof, or any combination thereof. In some embodiments, the plug may comprise various polymeric compounds configured to dissolve in the presence of an acid or basic fluid. Various soluble compounds may also be used to form at least a portion of the plug 110 while maintaining the strength to withstand the pressure differential across the plug. In an embodiment, at least a portion of the plug 110 may comprise a combination of sand and salt materials in a compressed state. The soluble plug may be configured to at least partially dissolve and/or hydrolyze in the presence of a suitable fluid and/or in response to one or more fluid pressure cycles. Such a soluble plug is commercially available as the Mirage® Disappearing Plug provided by Halliburton Energy Services, of Houston, Tex.

In an embodiment, any fluid comprising a suitable chemical capable of dissolving at least a portion of the plug may be used. In an embodiment, the chemical may comprise an acid, an acid generating component, a base, a base generating component, and any combination thereof. Examples of acids that may be suitable for use in the present invention include, but are not limited to organic acids (e.g., formic acids, acetic acids, carbonic acids, citric acids, glycolic acids, lactic acids, ethylenediaminetetraacetic acid (EDTA), hydroxyethyl ethylenediamine triacetic acid (HEDTA), and the like), inorganic acids (e.g., hydrochloric acid, hydrofluoric acid, nitric acid, sulfuric acid, phosphonic acid, p-toluenesulfonic acid, and the like), and combinations thereof. Examples of acid generating compounds may include, but are not limited to, polyamines, polyamides, polyesters, and the like that are capable of hydrolyzing or otherwise degrading to produce one or more acids in solution (e.g., a carboxylic acid, etc.). Examples of suitable bases may include, but are not limited to, sodium hydroxide, potassium carbonate, potassium hydroxide, sodium carbonate, and sodium bicarbonate. In some embodiments, additional suitable chemicals can include a chelating agent, an oxidizer, or any combination thereof. One of ordinary skill in the art with the benefit of this disclosure will recognize the suitability of the chemical used with the fluid to dissolve at least a portion of the plug based on the composition of the plug and the conditions within the wellbore.

In some embodiments, the plug may comprise one or more coating layers used to isolate the plug from the fluid until the coating is removed, thereby delaying the dissolution of the plug. In an embodiment, the coating may be disposed over at least a portion of the plug exposed to fluid. The coating can be designed to disperse, dissolve, or otherwise permit contact between the plug and the fluid when desired. The coating may comprise a paint, organic and/or inorganic polymers, oxidic coating, graphitic coating, elastomers, or any combination thereof which disperses, swells, dissolves and/or degrades either thermally, photo-chemically, bio-chemically and/or chemically, when contacted with a suitable stimulus, such as external heat and/or a solvent (such as aliphatic, cycloaliphatic, and/or aromatic hydrocarbons, etc.). In an embodiment, the coating may be configured to disperse, dissolve, or otherwise be removed upon contact with a chemical that is different than the fluid used to dissolve at least a portion of the plug. This may allow for one or more plugs to be selectively dissolved while other plugs comprising coatings remain disposed within the ports.

The selection of the materials for the dissolvable portion of the plug, the chemical intended to at least partially dissolve the plug, and the optional inclusion of any coating may be used to determine the rate at which the plug, or at least a portion of the plug, dissolves. Further factors affecting the rate of dissolution include the characteristics of the wellbore environment including, temperature, pressure, flow characteristics around the plug, and the concentration of the chemical in the fluid in contact with the plug. These factors may be manipulated to provide a desired time delay before the plug is dissolved and/or flow through the corresponding port is permitted.

The housing 112 generally comprises an annular member disposed about tubular member 102, forming an annulus chamber 114. Housing 112 includes a cylindrical outer portion 112*a* and a flanged portion 112*b* that extends radially therefrom to the tubular member 102, where it is fixed to an outer surface of the tubular member 102. Axially opposite flange 112*b* and adjacent to filter 104 is internal flange 112*c* that extends radially from portion 112*a* partially into chambers 114*a*, 114*b*, and, as described in more detail below, defines a portion of the first port 106. Housing 112 further includes a restrictor flange 112*d* having a portion that extends radially from portion 112*a* and a portion that extends radially from tubular member 102, where both portions partially extend into chambers 114*a*, 114*b* where they physically engage flow restrictor 116, thereby securing restrictor 116.

Flow restrictor 116 is configured to cause a fluid pressure differential across the restrictor in response to flowing a fluid through the flow restrictor in at least one direction. In an embodiment, flow restrictor 116 is an annular member that is disposed about the tubular member 102. In an embodiment, flow restrictor 116 may be cylindrical in shape and a plurality of cylindrical restrictors 116 may be circumferentially positioned about tubular member 102. In this embodiment, restrictor 116 has at least one fluid passage 118 that extends axially through the restrictor 116, having a diameter significantly smaller than the length of the passage 118. In other embodiments, restrictor 116 may take the form of an orifice restrictor, a nozzle restrictor, a helical restrictor, a u-bend restrictor, combinations thereof, or other types of restrictors suitable for creating a pressure differential across the restrictor. Such flow restrictors may be referred to as ICDs in some contexts. In some embodiments, the flow restrictor may comprise a device configured to create a differential resistance to flow based on the characteristics of the fluid flowing through the flow restrictor. Such devices are commonly referred to as autonomous inflow control devices (AICDs). In some embodiments, the flow restrictor may permit one-way flow, thereby allowing flow in a first direction with minimal resistance and substantially preventing flow in a second direction (e.g., presenting a high resistance). For example, the flow restrictor may comprise a check-valve or other similar device for providing one-way flow.

The flow restrictor 116 may be disposed within the restrictor flange 112*d* of housing 112 and restrictor 116 divide annulus chamber 114 into a first portion 114*a* and a second portion 114*b*. Portion 114*a* is disposed between restrictor flange 112*d*, filter 104 and internal flange 112*c*. Fluid exterior of assembly 100 (e.g., fluid in wellbore 12) may be communicated to portion 114*a* via port 106. Portion 114*b* is defined by restrictor flange 112*d* and flange 112*b* and fluid may be communicated to portion 114*b* via passage 118 of restrictor 116. In the first configuration of assembly 100, fluid communication between portion 114*b* and passage 102*a* may be substantially restricted by plug 110. In an embodiment, in response to a fluid flow between portions 114*a*, 114*b*, the restrictor 116 is configured to cause a pressure drop between the portions 114*a*, 114*b*.

In an embodiment, the plug 110 may be disposed at least partially in the central passage 118 of the flow restrictor. In this embodiment, the plug 110 may substantially prevent fluid flow through the flow restrictor until at least partially dissolved. In some embodiments, the flow restrictor may comprise one or more liners arranged over at least a portion of the central passage through the flow restrictor. The liners may comprise one or more materials configured to dissolve in response to being contacted by a suitable fluid including, for example, any of those materials and fluids used to form and dissolve the plug 110. When contacted by a suitable fluid, the liner may at least partially dissolve and provide a different resistance to flow through the flow restrictor. For example, the one or more liners may be dissolved to provide a central passage 118 through the flow restrictor 116 having a larger diameter, thereby presenting a lower resistance to flow than the flow restrictor comprising the liner, but still larger than a flow resistance that completely by-passes the flow restrictor. The liner may be dissolvable in response to the same fluid as the plug or a different fluid. The use of a plurality of liners, each dissolvable in response to different chemicals in one or more fluids, may allow for a desired flow resistance through a flow restriction to be achieved without the need for physically intervening in the well or physically accessing the flow restrictor with anything other than a fluid. For example, three liners could be arranged in concentric alignment through the central passage of the flow restrictor. The dissolution of the first liner, the second liner, and/or the third liner, in that specific order, in response to one or more fluids may provide a selectable flow diameter through the flow restrictor of four different sizes. In an embodiment, any plurality of liners can be used. One or more coatings as described herein may be used with any optional liner used with one or more flow restrictors.

Filter 104 comprises an annular member that is disposed about tubular member 102 and is configured to substantially reduce and filter the flow of sand particles and other debris of a predetermined size through the filter 104. In an embodiment, the filter 104 may be a type known as "wire-wrapped," where wire is closely wrapped helically about tubular member 102, with the spacing between each windings of wire designed to allow the passing of fluid but not of sand or other debris larger than a certain size. Other types of filters may also be used, such as sintered, mesh, pre-packed, expandable, slotted, perforated and the like.

In the first configuration, as shown in FIG. 2A, assembly 100 is configured to substantially restrict fluid flow between an exterior of the assembly (e.g., wellbore 12) and passage 102*a* of tubular member 102. In this configuration, assembly 100 is configured to allow for fluid in wellbore 12 to be circulated down the wellbore 12 to a downhole end of tubular member 102, without allowing it to be diverted through port 108, where it may be circulated uphole in passage 102*a* to the surface, or vice-a-versa (e.g., downhole in passage 102*a*, uphole in wellbore 12). Further, assembly 100 is configured to prevent substantial fluid flow through filter 104, protecting filter 104 from fouling or clogging from sand or other debris.

Referring again to FIG. 1, at a certain time during the life of the well, it may be advantageous to allow for a route of fluid communication through at least one well screen assembly 24. For instance, it may be desirable to open an assembly 24 upon the completion of the well system 10, such as after wellbore 12 has been cleaned and all fluids have been circulated through wellbore 12. In another embodiment, it may be advantageous to open an assembly 24 upon the completion of a gravel pack within the wellbore 12, or upon the activation of a well system 10 that has been shut-in for a period of time. Thus, a means for allowing a route of fluid communication between tubular member 102 and the wellbore 12 via at least one well screen assembly 24 may become desirable in order to begin hydrocarbon production from formation 26.

Figure 2B:
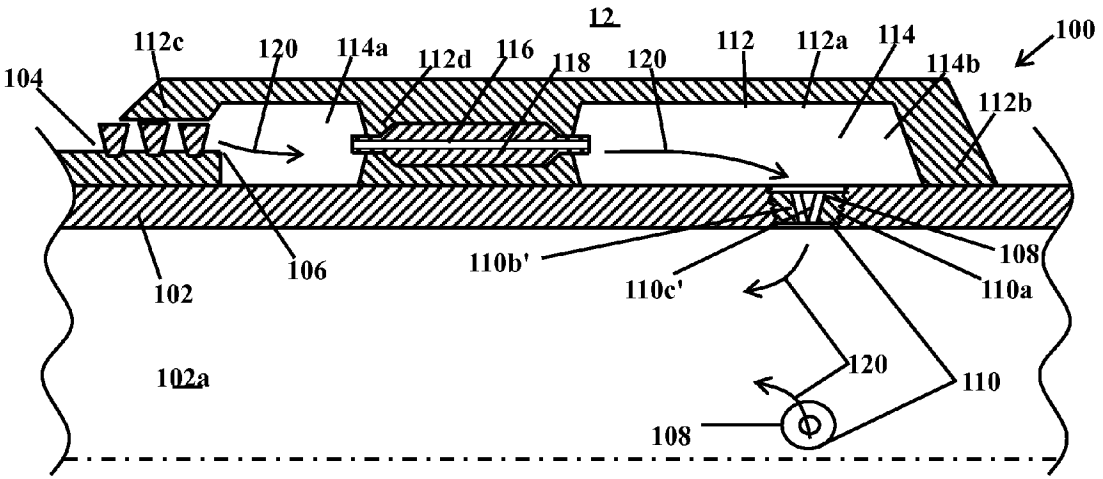
FIG. 2B is a partial cross-sectional view of an embodiment of the well screen assembly of FIG. 2A shown in a second configuration.

Referring to FIG. 2B, a second configuration of well screen assembly 100 is shown. In this configuration, assembly 100 is configured to allow for fluid communication between passage 102*a* of member 102 and an exterior of the assembly 100 (e.g., wellbore 12) via port 108. More particularly, pressure may be decreased within passage 102*a* of tubular member 102, such as through pumping fluid in tubular member 102 uphole at the surface, creating a pressure differential between the wellbore 12 (relatively higher pressure) and passage 102*a* (relatively lower pressure). This pressure differential causes a flow of fluid between wellbore 12 and passage 102*a* along flowpath 120. In this configuration, cavity 110*c*' extends entirely through plug 110 as inner surface 110*b*' has been eroded, allowing for fluid communication between portion 114*b* and passage 102*a* of tubular member 102. Fluid in flowpath 120 moves from wellbore 12, through filter 104 and enters portion 114*a* via port 106. Fluid in flowpath 120 then enters central passage 118 of restrictor 116, followed by flowing through portion 114*b* and then enters passage 102*a* via cavity 110*c*' disposed in port 108.

Referring to FIGS. 2A and 2B, assembly 100 is configured to transition from the first configuration of FIG. 2A to the second configuration of FIG. 2B. For instance, assembly 100 is configured to substantially restrict fluid communication between the wellbore and the inner passage 102*a* of a tubular member in a first configuration, and then transition from the first configuration to the second configuration, where assembly 100 provides a route of fluid communication from a wellbore to the passage of the member. Specifically, assembly 100 may be configured to transition from the first configuration of FIG. 2A to the second configuration of FIG. 2B via pumping a sufficient quantity of fluid comprising a chemical down wellbore 12, through filter 104, and into chambers 114*a*, 114*b* where it may contact plug 110 for a predetermined period of time. During this period of contact, inner surface 110*b*, defining cavity 110*c*, dissolves to inner surface 110*b*', defining cavity 110*c*', where the length of cavity 110*c*' is greater than the length of cavity 110*c* and cavity 110*c*' extends completely through plug 110. In an embodiment, the fluid may be pumped down the wellbore 12 and contacted with plug 110 for a period of time sufficient to at least partially dissolve the plug and establish fluid communication through the plug and or port. In another embodiment, a sufficient quantity of fluid comprising a suitable chemical may be pumped downhole through passage 102*a* of tubular member 102 until it contacts plugs 110 for a predetermined period of time before forming cavity 110*c*'. In the embodiment where plug 110 comprises a soluble plug, either passage 102*a* of tubular member 102 or wellbore 12 may be pressurized such as to pressurize a surface of plug 110 at a sufficient pressure to dissolve the plug 110. In this embodiment, plug 110 may be configured such that multiple pressurizations must be completed before plug 110 will dissolve and allow for a route of fluid communication between passage 102*a* and chambers 114*a*, 114*b* via port 108.

Figure 3A:
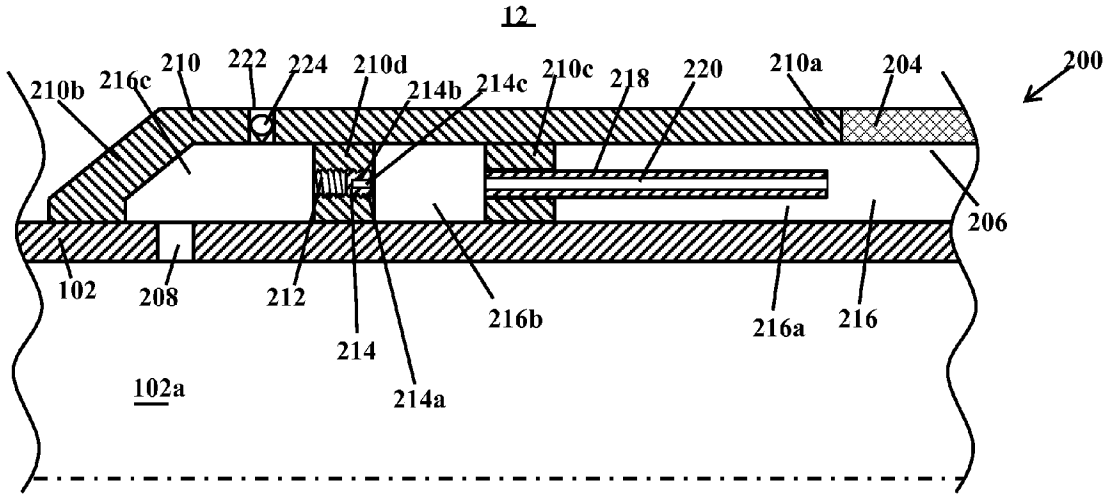
FIG. 3A is a partial cross-sectional view of an embodiment of a well screen assembly for selectively providing a route of fluid communication in a well system shown in a first configuration.

In an embodiment, the plug may be placed at any location in series with the flow restrictor including, but not limited to, in series with one or more individual flow restrictors disposed about the circumference of the tubular member 102. Referring to FIG. 3A, therein is depicted a cross-sectional view of an embodiment of a first configuration of a well screen assembly 200 that is suitable for use as a well screen assembly 24 as previously described with reference to FIG. 1. Well screen assembly 200 may be the same or similar to the well screen assembly 100 described with respect to FIGS. 2A and 2B, and like parts will not be fully described in the interest of clarity. Well screen assembly 200 generally includes tubular member 102, a filter 204, a first or inlet port 206, a second or outlet port 208, a housing 210 having a port 212 where a sacrificial plug 214 is disposed therein, a chamber 216 defined by housing 210 and tubular member 102, and a flow restrictor 218 having a central passage 220 extending therethrough.

In this embodiment, tubular member 102 comprises port 208 that radially extends through tubular member 102 that is configured to allow fluid communication between passage 102*a* of tubular member 102 and chamber 216. In an embodiment, a plurality of ports 208 may be disposed along a circumference of tubular member 102. In another embodiment, port 208 may comprise a circumferential and/or radial slot that extends along a portion of tubular member 102.

The housing 210 comprises an annular member disposed about tubular member 102, forming annulus chamber 216. Housing 210 includes a cylindrical outer portion 210*a* and a flanged portion 210*b* that extends radially therefrom to the tubular member 102, where it is fixed to an outer surface of the tubular member 102. Housing 210 further includes a restrictor flange 210*c* and a plug flange 210*d*, each comprising an annular member disposed about tubular member 102 and extending radially from portion 210*a* to tubular member 102 where flanges 210*c*, 210*d* are fixed to tubular member 102.

Extending through flange 210*c* is an annular flow restrictor 218 having an annular passage 220 extending therethrough, which is configured to cause a fluid pressure differential across the restrictor 218 in response to flowing a fluid through the flow restrictor 218. In this embodiment, restrictor 218 comprises an annular member that extends circumferentially about member 102 with a central passage 220 that also extends circumferentially about tubular member 102. Passage 220 has a radial thickness that is significantly smaller than the length of passage 220. In other embodiments, restrictor 218 may take the form of an orifice restrictor, a helical restrictor, a u-bend restrictor, combinations thereof, or any of the other types of flow restrictors described herein that are suitable for creating a pressure differential in at least one direction.

Restrictor flange 210*c* physically engages restrictor 218, fixing restrictor 218 in place. Restrictor flange 210*c* of housing 210 and restrictor 218 divide annulus chamber 216 into a first portion 216*a* and a second portion 216*b*. Portion 216*a* is disposed between portion 210*a*, restrictor flange 210*c* and filter 204. Fluid exterior of assembly 200 (e.g., fluid in wellbore 12) may be communicated to portion 216*a* via port 206, which is proximal to filter 204. Portion 216*b* is defined by restrictor flange 210*c* and plug flange 210*d*. Fluid may be communicated to portion 216*b* from portion 216*a* via passage 220 of restrictor 218. Plug flange 210*d* comprises a port 212 for threadedly engaging sacrificial plug 214. Flange 210*d* further divides chamber 216 into second portion 216*b* and a third portion 216*c*, where portion 216*c* is defined by portions 210*a*, 210*b* and flange 210*d* of housing 210 and tubular member 102. In the first configuration of assembly 200, while fluid may be communicated between passage 102*a* and portion 216*c* via port 208, fluid communication between portion 216*b* and portion 216*c* of chamber 216 may be substantially restricted by the engagement between plug 214 and flange 210*d*. In this embodiment, housing 210 further includes a port 222 and a check valve 224 that provides for fluid communication flowing from portion 216*c* of chamber 216 to the wellbore 12, but substantially restricts flow from wellbore 12 to portion 216*c* of chamber 216.

Disposed at least partially in port 212 is plug 214. In this embodiment, plug 214 comprises an annular member that extends circumferentially about tubular member 102 and threadedly engages flange 210*d* with threads 214*a*. Plug 214 further includes an annular inner surface 214*b* that defines an annular cavity 214*c* that axially extends partially into plug 214. As discussed previously, a sacrificial plug, such as sacrificial plug 214, may comprise a material that is configured to dissolve when contacted with a fluid comprising a suitable chemical. Further, plug 214 may be formed of a material configured to at least partially dissolve in response to pressurization of plug 214.

Filter 204 comprises an annular member that is disposed about tubular member 102 and extends from portion 210*a* of housing 210. Filter 204 is configured to substantially reduce and filter the flow of sand particles and other debris of a predetermined size through the filter 204. In an embodiment, filter 204 may comprise a filter type known as a "mesh screen," comprising a woven mesh material and a perforated shroud, where the sizing of the mesh is configured to allow the passing of a fluid therethrough but not of sand or other debris larger than a certain size. Other types of filters may also be used, such as wire wrapped, sintered, pre-packed, expandable, slotted, perforated and the like.

In the first configuration, as shown in FIG. 3A, assembly 200 is configured to substantially restrict fluid flow between an exterior of the assembly (e.g., wellbore 12) and passage 102*a* of tubular member 102. As described previously, in this configuration, a well screen assembly, such as assembly 200, is configured to allow for fluid in wellbore 12 to be circulated down the wellbore 12 to a downhole end of tubular member 102, without allowing it to be diverted through port 208, where it may be circulated uphole in passage 102*a* to the surface. Further, assembly 200 is configured to prevent substantial fluid flow through filter 204, protecting filter 204 from fouling or clogging from sand or other debris.

Figure 3B:
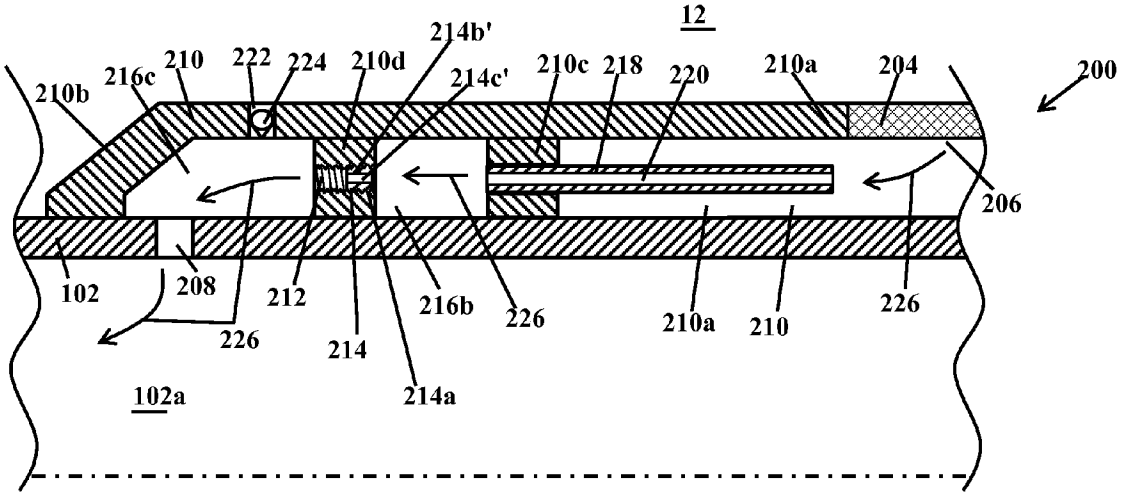
FIG. 3B is a partial cross-sectional view of an embodiment of the well screen assembly of FIG. 3A shown in a second configuration.

As described previously, for myriad reasons it may be advantageous to allow for a route of fluid communication through a well screen assembly. Referring to FIG. 3B, a second configuration of well screen assembly 200 is shown. In this configuration, assembly 200 is configured to allow for fluid communication between passage 102*a* of tubular member 102 and an exterior of the assembly 200 (e.g., wellbore 12) via port 208. More particularly, pressure may be decreased within passage 102*a* of tubular member 102, causing a flow of fluid between wellbore 12 and passage 102*a* along flowpath 226. In this configuration, cavity 214*c*' extends entirely through plug 214 as inner surface 214*b*' has been dissolved, dispersed, or otherwise removed, allowing for fluid communication between portion 216*b* of chamber 216 and portion 216*c* and passage 102*a* of tubular member 102. Fluid in flowpath 226 moves from wellbore 12, through filter 204, entering portion 216*a* of chamber 216 via port 206. Fluid in flowpath 226 then enters passage 220 of restrictor 218, followed by flowing through portion 216*b* of chamber 216, entering portion 216*c* via cavity 214*c*' disposed in port 212. From portion 216*c*, fluid in flowpath 226 may enter passage 102*a* of tubular member 102 via port 208.

Referring to FIGS. 3A and 3B, as discussed previously, an assembly, such as assembly 200, may be configured to transition from the first configuration of FIG. 3A to the second configuration of FIG. 3B via pumping a sufficient quantity of a fluid comprising a suitable chemical down wellbore 12, through filter 204, and into chamber 216, or vice versa, where it may contact plug 214 for a predetermined period of time. The inner surface 214*b* forming cavity 214*c* may dissolve to form inner surface 214*b*' forming cavity 214*c*', where the length of cavity 214*c*' is greater than the length of cavity 214*c* and cavity 214*c*' extends completely through plug 214. In the embodiment where plug 214 comprises a soluble plug, either passage 102*a* of tubular member 102 or wellbore 12 may be pressurized such as to pressurize a surface of plug 214 at a sufficient pressure to dissolve the plug 214. In this embodiment, plug 214 may be configured such that multiple pressurizations must be completed before plug 214 will dissolve and allow for a route of fluid communication between passage 102*a* and chamber 216 via ports 208, 212.

While described herein as having a plug placed in series with the flow restrictor, one or more plugs may be placed in series with each of a plurality of flow restrictors disposed about the circumference of the tubular member 102. Each of the plugs may be constructed of the same or different materials and may comprise one or more optional coatings. This may allow for the selection of the flow resistance through a well screen assembly using fluid circulation (e.g., circulation of a plurality of fluids sequentially or simultaneously). For example, a first plug may be placed in series with a first flow restrictor and a second plug may be placed in series with a second flow restrictor in a single well screen assembly. When a plurality of plugs are present in a single well screen assembly, the plugs may be constructed of the same or different materials, which in an embodiment, may dissolve in response to being contacted with fluids comprising different chemicals. For example, the first plug may be configured to at least partially dissolve in response to being contacted with an acid while the second plug may be configured to dissolve in response to being contacted with a base. In this embodiment, the first plug may be removed by circulating an acid in the well screen assembly to contact the first plug. When at least partially dissolved, flow through a first port from which the first plug has been removed may establish a flow path through the first flow restrictor to provide a first resistance through the well screen assembly. A second fluid comprising a base may then be circulated in the well screen assembly to contact the second plug. When at least partially dissolved, flow through a second port from which the second plug has been removed may establish a flow path through the second flow restrictor to provide a second resistance through the well screen assembly, wherein the second resistance represents the combined resistances of the first flow restrictor and the second flow restrictor.

Figure 4A:
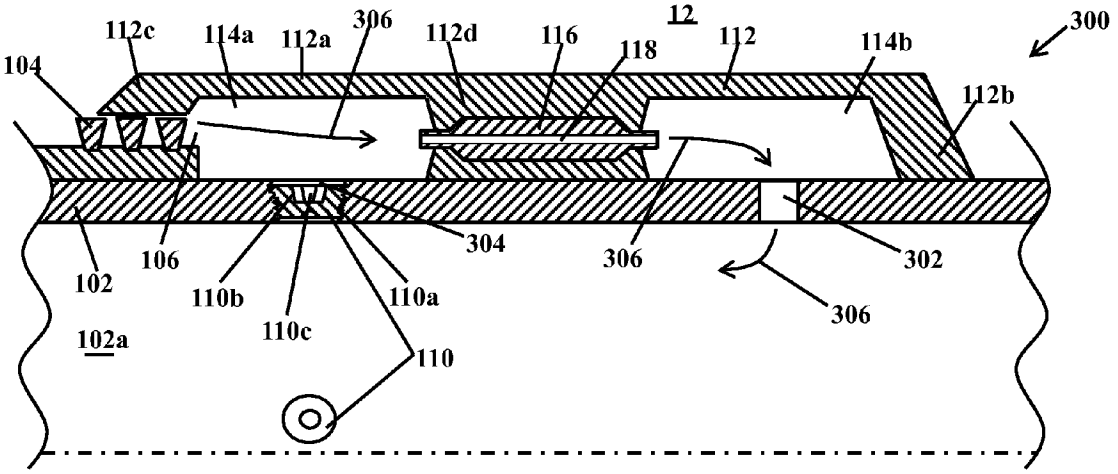
FIG. 4A is a partial cross-sectional view of an embodiment of a well screen assembly for bypassing a component of a well system shown in a first configuration.

In an embodiment, the plug may be placed in parallel to the flow restrictor, allowing the plug to bypass the flow restrictor. Referring to FIG. 4A, therein is depicted a cross-sectional view of an embodiment of a well screen assembly 300 suitable for use as a well screen assembly 24 previously described with reference to FIG. 1. Well screen assembly 300 may be the same or similar to the well screen assemblies 100 and 200 described with respect to FIGS. 2A, 2B, 3A, and 3B, and like parts will not be fully described in the interest of clarity. Well screen assembly 300 generally includes tubular member 102, filter 104, first port 302, second port 304 with sacrificial plug 110 disposed therein, housing 112 that partially defines chambers 114*a*, 114*b* and flow restrictor 116 having central passage 118 extending therethrough.

In this embodiment, tubular member 102 comprises a first outlet port 302 and a second outlet port 304. First outlet port 302 radially extends through tubular member 102 and provides for fluid communication between portion 114*b* and passage 102*a* of tubular member 102. Second outlet port 304 radially extends through tubular member 102 and, in a second configuration that will be described further below, provides for a route of fluid communication between portion 114*a* and passage 102*a* of tubular member 102. Disposed at least partially within port 304 is plug 110, which is threadedly received in port 304. In the first configuration of FIG. 4A, fluid may enter passage 102*a* of tubular member 102 from wellbore 12 along fluid flowpath 306. In this configuration, upon the creation of a differential pressure between wellbore 12 and passage 102*a*, such as through pumping fluid uphole through passage 102*a*, fluid in flowpath 306 flows through filter 104 and into portion 114*a*, where the fluid may flow through restrictor 116 via passage 118 and into portion 114*b*. Once in chamber 114*b*, the fluid flowing along flowpath 306 may enter passage 102*a* of tubular member 102 via port 302. As shown in FIG. 4A, in this configuration fluid flowing from wellbore 12 to passage 102*a* is substantially restricted from flowing through port 304 and bypassing restrictor 116. Thus, in this configuration, assembly 200 is configured to provide a flowpath through restrictor 116, resulting in a pressure drop across restrictor 116.

Referring again to FIG. 1, at a certain time during the production of hydrocarbons from well system 10, it may be advantageous to bypass the flow restrictor 116 of well screen assembly 300 in order to allow for a higher fluid flow rate to enter the tubular string 20 from a surrounding formation 26. For instance, a relatively uniform flow rate for each individual well screen assembly 24 is often initially desired in order to delay water or gas production into the tubular string 20 from the formation 26. Once a well system 10 has begun producing water or gas from the formation 26, the advantage of a uniform metered flow from well screen assemblies 24 is diminished, and instead, increased flow rates may be desired in order to capture any remaining hydrocarbons left in the formation 26. Thus, a means for reducing flow restrictions within the well screen assemblies 24 then becomes desirable in order to increase the flow rate entering the tubular string 20 from the formation 26.

Figure 4B:
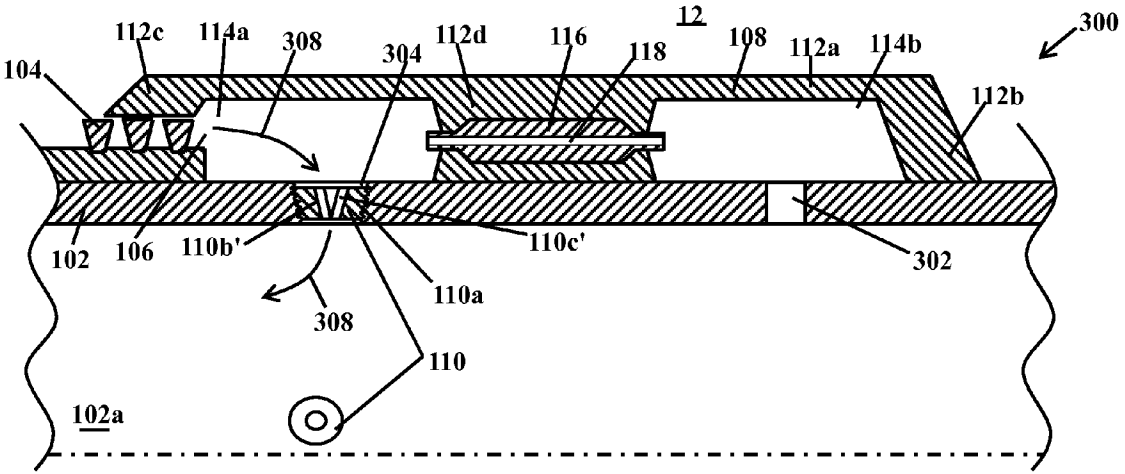
FIG. 4B is a partial cross-sectional view of an embodiment of the well screen assembly of FIG. 4A shown in a second configuration.

Referring now to FIG. 4B, the second configuration of the well screen assembly 300 of FIG. 4A is shown. In the second configuration, assembly 300 is configured to allow the assembly to lessen the flow restrictions (and thereby increase fluid intake). Specifically, in the second configuration, assembly 300 is configured to allow for fluid communication between the wellbore 12 and passage 102*a* of tubular member 102 via port 304. In this embodiment, pressure may be decreased within passage 102*a* of tubular member 102, such as through pumping fluid in tubular member 102 uphole at the surface, creating a pressure differential between the wellbore 12 (relatively higher pressure) and passage 102*a* (relatively lower pressure). This pressure differential causes a flow of fluid between wellbore 12 and passage 102*a* along a flowpath 308. In this configuration, cavity 110*c*' extends entirely through plug 110 as inner surface 110*b*' has been eroded, allowing for fluid communication between portion 114*a* of chamber 114 and passage 102*a* of tubular member 102. Fluid in flowpath 308 moves from wellbore 12, through filter 104 and enters portion 114*a* via port 106. Fluid in flowpath 308 then enters passage 102*a* of tubular member 102 via cavity 110*c*' disposed in port 304.

Allowing the flow path 308 to deviate around the flow restrictor 116 and, in this embodiment, to bypass the small diameter fluid passage 118 of restrictor 116, provides a path with a substantially larger cross-sectional area for fluid to flow through, providing for less restriction for the flow and a smaller pressure drop between the fluid entering the first port 106 and the fluid exiting the port 304. Thus, by creating and employing a less restrictive flow path 308, a higher flow rate of fluid from formation 26 may be produced through the well screen assembly 300 as compared to the first flow path 306 of FIG. 4A. While in the second configuration fluid is free to travel through restrictor 116, due to the restriction of flow restrictor 116 is configured to provide, a substantial portion of the fluid flowing from wellbore 12 to passage 102*a* will flow along the relatively less restrictive flowpath 308.

Referring to FIGS. 4A and 4B, assembly 300 is be configured to transition from the first configuration of FIG. 4A to the second configuration of FIG. 4B. For instance, assembly 300 is configured to provide a first route of fluid communication from a wellbore, through a flow restrictor and to a passage of a tubular member in a first configuration, and then transition from the first configuration to the second configuration, which provides a second route of fluid communication from a wellbore to the passage, bypassing the flow restrictor. Specifically, assembly 300 transitions from the first configuration to the second configuration via pumping a sufficient quantity of a chemical, such as an acid, down wellbore 12, through filter 104, and into chambers 114*a*, 114*b* where it may contact plug 110 for a predetermined period of time. As discussed previously, during this period of contact, inner surface 110*b*, defining cavity 110*c*, dissolves to inner surface 110*b*', defining cavity 110*c*'. In the embodiment where plug 110 comprises a soluble plug, either passage 102*a* of tubular member 102 or wellbore 12 may be pressurized such as to pressurize a surface of plug 110 at a sufficient pressure to dissolve the plug 110. In this embodiment, plug 110 may be configured such that multiple pressurizations must be completed before plug 110 will dissolve and allow for a route of fluid communication between passage 102*a* and chambers 114*a*, 114*b* via port 108.

While described herein as having one or more plugs being placed in series or parallel with the flow restrictor, any of the various embodiments may be combined to provide the desired selectable flow paths. For example, a first plug may be placed in series with the flow restrictor and a second plug may be placed in parallel with the flow restrictor. When a plurality of plugs are present in a single well screen assembly, the plugs may be constructed of the same or different materials, which in an embodiment, may dissolve in response to being contacted with fluids comprising different chemicals. For example, the first plug in series with the flow restrictor may be configured to at least partially dissolve in response to being contacted with an acid while the second plug in parallel with the flow restrictor may be configured to dissolve in response to being contacted with a base. In this embodiment, the first plug may be removed by circulating an acid in the well screen assembly to contact the first plug. When at least partially dissolved, flow through a first port from which the first plug has been removed may establish a flow path through the flow restrictor. At a later time when the flow restrictor is to be bypassed, a fluid comprising a base may be circulated in the well screen assembly to contact the second plug. When at least partially dissolved, flow through a second port from which the second plug has been removed may establish a second flow path that bypasses the flow restrictor.

In some embodiments, one or more of the plugs may comprise a coating configured to dissolve, disperse, or otherwise be removed from the plug in response to a different chemical. For example, the first plug in series with the flow restrictor may be configured to at least partially dissolve in response to being contacted with an acid, while the second plug, which may also be acid dissolvable, may be disposed in parallel with the flow restrictor and may comprise a coating configured to dissolve in response to being contacted with a base and/or a solvent. In this embodiment, the first plug may be removed by circulating an acid in the well screen assembly to contact the first plug. During the circulation of the acid, the second plug may be protected by the coating and remain intact. When at least partially dissolved, flow through a first port from which the first plug has been removed may establish a flow path through the flow restrictor. At a later time when the flow restrictor is to be bypassed, a fluid comprising a base and/or a solvent may be circulated in the well screen assembly to contact the second plug. The coating may be removed from the second plug in response to the base and/or solvent, exposing the second plug to a subsequent fluid comprising an acid. The subsequent fluid comprising the acid may then be circulated to at least partially dissolve the second plug. When at least partially dissolved, flow through a second port from which the second plug has been removed may establish a second flow path that bypasses the flow restrictor.

In an embodiment, one or more plugs associated with one or more well screen assemblies may comprise the same or different materials and/or one or more coatings. The combination of the use of different materials and/or coatings may allow for the selective removal of a portion of the plugs along the string of well screen assemblies. For example, all or a portion of the plugs in series with a plurality of flow restrictors may be selectively removed in response to one or more fluids. In an embodiment, all or a portion of the plugs in parallel with the plurality of flow restrictors may be selectively removed in response to one or more fluids. In this manner, each well screen assembly along a string of well screen assemblies may be selectively opened and/or bypassed as desired through the selection of materials for the plugs and/or the coatings and the fluid selection used to remove the plugs. In an embodiment, all or a portion of any optional liners used with the plurality of flow restrictors may be selectively removed in response to one or more fluids. In this manner, the flow resistance through one or more flow restrictors in a string of well screen assemblies may be selectively adjusted as desired through the selection of materials for the liners and/or any coatings and the fluid selection used to remove the liners.

In an embodiment, a method for selectively providing a route of fluid communication may comprise contacting a plug, which may be disposed in series with a flow restrictor, with a fluid comprising a suitable chemical so as to at least partially dissolve the plug, and flowing a fluid through a flow path from a first port to a second port. In an embodiment, a method for bypassing a well system component may comprise flowing a fluid through a first flow path from a first port to a second port, where the first flowpath includes a well system component, contacting a plug, which may be disposed in parallel with a flow restrictor, with a chemical so as to at least partially dissolve the plug, and flowing a fluid through a second flow path from the first port to the second port.

In an embodiment, another method for producing hydrocarbons from a well system may comprise flowing a chemical (e.g., an acid, base, etc.) into a wellbore such that it contacts at least one plug disposed within the wellbore for a period of time sufficient to at least partially dissolve the plug. During the contact between the plug and the chemical, the plug may at least partially dissolve, allowing for fluid communication between two volumes that had been previously substantially restricted. Once the plug has been at least partially dissolved to allow for a route of fluid communication, flowing a fluid from a formation into an internal passageway of a production string coupled to the plug via a cavity disposed within the dissolved plug. The flow of fluid into the internal passageway may be caused by pumping fluid into the passageway. In another embodiment, different sections of the production string may be isolated from each other, allowing the fluid pumped into the wellbore to only contact predetermined plugs, leaving other plugs of the production string undisturbed.

In an embodiment, another method for producing hydrocarbons from a well system may comprise flowing a fluid from a formation into an internal passageway of a production string. As the fluid enters the production string, it flows through a filter and a flow restrictor to create a pressure drop in the fluid flow as it enters the internal passageway. After a period of producing fluid from the formation, a chemical (e.g., an acid, base, etc.) may be pumped into the production string from the surface, such that the chemical contacts at least one plug disposed within the wellbore for a predetermined period of time. During the contact between the plug and the chemical, the plug at least partially dissolves, allowing for fluid communication between two volumes that had been previously substantially restricted. Once the plug has been at least partially dissolved to allow for a route of fluid communication, pressure within the internal passageway of the production string may be decreased via pumping fluid uphole in the production string, such as to create an external pressure differential where the pressure within the formation and wellbore is higher than the pressure within the internal passageway, causing flow into the internal passageway which may now bypass the ICD due to the dissolving of the plug. A fluid flow into the internal passageway from the formation may have a lower pressure drop due to bypassing the flow restrictor disposed within the ICD.

While specific embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A well screen assembly for use in a wellbore comprising:

a first fluid pathway configured to provide fluid communication between an exterior of a wellbore tubular and an interior of the wellbore tubular;

a flow restrictor disposed in the first fluid pathway; and a first plug disposed in parallel with the flow restrictor, wherein the first plug is configured to be at least partially dissolvable when contacted by a first suitable fluid, and wherein the first plug is configured to create a second fluid pathway between an exterior of the wellbore tubular and the interior of the wellbore tubular when at least partially dissolved; and a second plug disposed in series with the flow restrictor in the first fluid pathway, wherein the second plug substantially prevents a fluid flow through the first fluid pathway, wherein the second plug is configured to be at least partially dissolvable when contacted by a second suitable fluid, and wherein the second plug is configured to allow the fluid flow through the first fluid pathway when at least partially dissolved.

2. The well screen assembly of claim 1, wherein the first plug is configured to not be dissolvable in the second suitable fluid.

3. The well screen assembly of claim 1, wherein at least one of the first plug and the second plug comprises a coating, wherein the coating is configured to be at least partially dissolvable when contacted by a third suitable fluid.

4. The well screen assembly of claim 3, wherein the coating is configured to not be dissolvable in the second suitable fluid.

5. The well screen assembly of claim 1, wherein at least one of the first and the second plug comprises a metal, and wherein the metal comprises at least one component selected from the group consisting of: barium, calcium, sodium, magnesium, aluminum, manganese, zinc, chromium, iron, cobalt, nickel, tin, any alloy thereof, any composite thereof, and any combination thereof.

6. The well screen assembly of claim 1, wherein at least one of the first suitable fluid and the second suitable fluid comprises at least one of an acid, an acid generating compound, a base, a base generating compound, a chelating agent, an oxidizer, or any combination thereof.

7. The well screen assembly of claim 1, wherein the wellbore tubular comprises a plurality of ports disposed in the first and second fluid pathway, and wherein the first and second plugs is disposed in the plurality of ports.

8. The well screen assembly of claim 1, wherein the second plug is disposed in a central passage through the flow restrictor.

9. The well screen assembly of claim 1, wherein the flow restrictor comprises a liner, and wherein the liner is configured to be at least partially dissolvable when contacted by a third suitable fluid, and wherein the flow restrictor is configured to provide a first resistance to flow with the liner and a second resistance to flow when the liner is at least partially dissolved.

10. A method comprising:

preventing, by a first plug, fluid flow through a fluid pathway in a well screen assembly, wherein the fluid pathway is configured to provide fluid communication between an exterior of a wellbore tubular and an interior of the wellbore tubular, wherein a flow restrictor is disposed in the fluid pathway, and wherein the first plug is in series with the flow restrictor in the fluid pathway;

contacting the first plug with a first suitable fluid;

at least partially dissolving the first plug in response to the contact with the first suitable fluid;

allowing the fluid flow through the fluid pathway in response to at least partially dissolving the first plug; and contacting a second plug with a second suitable fluid, wherein the second plug is disposed in parallel with the flow restrictor, and wherein the second plug is configured to be at least partially dissolvable when contacted by the second suitable fluid.

11. The method of claim 10, wherein the first suitable fluid and the second suitable fluid comprise different chemicals.

12. The method of claim 10, wherein at least one of the first and the second plug comprises a metal, and wherein the metal comprises at least one component selected from the group consisting of: barium, calcium, sodium, magnesium, aluminum, manganese, zinc, chromium, iron, cobalt, nickel, tin, any alloy thereof, any composite thereof, and any combination thereof.

13. The method of claim 10, wherein at least one of the first suitable fluid and the second suitable fluid comprises at least one of an acid, an acid generating compound, a base, a base generating compound, a chelating agent, an oxidizer, or any combination thereof.

14. The method of claim 10, wherein the wellbore tubular comprises a port disposed in the fluid pathway, and wherein the first plug is disposed in the port.

15. The method of claim 10, wherein the first plug is disposed in a central passage through the flow restrictor.

16. The method of claim 10, wherein the flow restrictor comprises a liner, and wherein the liner is configured to be at least partially dissolvable when contacted by a third suitable fluid, and wherein the flow restrictor is configured to provide a first resistance to flow with the liner and a second resistance to flow when the liner is at least partially dissolved.

* * * * *